US008100131B2

(12) United States Patent
Swann et al.

(10) Patent No.: US 8,100,131 B2
(45) Date of Patent: Jan. 24, 2012

(54) MOUTHGUARD

(75) Inventors: Paul Swann, Hatfield (GB); Peter Searle, Hatfield (GB)

(73) Assignee: OPRO International Ltd., Welham Green (GB)

( * ) Notice: Subject to any disclaimer, the term of this patent is extended or adjusted under 35 U.S.C. 154(b) by 313 days.

(21) Appl. No.: 12/296,898

(22) PCT Filed: Apr. 5, 2007

(86) PCT No.: PCT/GB2007/001300

§ 371 (c)(1),
(2), (4) Date: Aug. 26, 2009

(87) PCT Pub. No.: WO2007/116213

PCT Pub. Date: Oct. 18, 2007

(65) Prior Publication Data

US 2010/0024833 A1 Feb. 4, 2010

(30) Foreign Application Priority Data

Apr. 11, 2006 (GB) ..... 0607305.0

(51) Int. Cl.
*A61C 5/14* (2006.01)
*A61C 3/00* (2006.01)

(52) U.S. Cl. ..... 128/861; 128/862; 433/6; 433/7

(58) Field of Classification Search ..... 128/859–862, 128/848; 433/6–7; 264/16; 602/902
See application file for complete search history.

(56) References Cited

U.S. PATENT DOCUMENTS

| | | | | |
|---|---|---|---|---|
| 4,568,280 | A | 2/1986 | Ahlin | |
| 5,732,715 | A | 3/1998 | Jacobs | |
| 5,865,619 | A | 2/1999 | Cross, III et al. | |
| 5,931,164 | A | 8/1999 | Kiely et al. | |
| 6,302,110 | B1 * | 10/2001 | Yoshida | 128/848 |
| 2003/0136416 | A1 | 7/2003 | White | |
| 2006/0065277 | A1 | 3/2006 | Jacobs | |

FOREIGN PATENT DOCUMENTS

| | | | |
|---|---|---|---|
| CA | 886 254 A | | 11/1971 |
| CA | 886254 A | * | 11/1971 |

OTHER PUBLICATIONS

PCT/GB2007/001300 International Search Report, dated Jun. 19, 2007, 3 pp.

* cited by examiner

*Primary Examiner* — Patricia Bianco
*Assistant Examiner* — Ophelia Hawthorne
(74) *Attorney, Agent, or Firm* — Knobbe Martens Olson & Bear, LLP

(57) ABSTRACT

A "boil and bite" mouthguard including projections to improve moulding of the mouthguard to the user's teeth is described. The mouthguard also includes a base-wall configuration that acts to minimise thinning of the base during moulding and use of the mouthguard.

15 Claims, 2 Drawing Sheets

MOUTHGUARD

This invention relates to a mouthguard with improved moulding capabilities.

Mouthguards are commonly used in sports such as hockey and rugby in order to protect a player's facial and oral hard and soft tissue from damage caused by external forces.

This is especially important in high impact sports where trauma to the mouth or face can occur. For example, they act to prevent the teeth in the lower jaw from contacting the teeth in the upper jaw. This means that there is less likelihood of a tooth breaking, a tooth being knocked out, concussion, fracture of the jaw or damage to the soft tissue of the mouth when a force is applied to the lower facial area.

One type of mouthguard is known as a "stock mouthguard". This type of mouthguard is supplied to the user in the form in which it is to be used. However, this means that the mouthguard is not suited to the shape of the user's mouth and may, for example, not cover all of the user's teeth.

Furthermore, in view of the bad fit between the mouthguard and the user's teeth it is usual for the mouthguard to not be retained by the user's teeth. This means that the mouthguard is loose and users may need to use their lower jaw, tongue or lips to hold the guard in place. This makes it more difficult for the user to speak and may possibly impair breathing.

In order to overcome these limitations so called "boil and bite" mouthguards are used in place of stock mouthguards. Boil and bite mouthguards are made from thermoplastic materials. On heating, often in boiling water, all or part of the mouthguard becomes soft and pliable. The mouthguard can then be inserted into user's mouth and pressure applied so that the material may adapt to the user's teeth.

However, although there is an improved fit from these mouthguards in relation to the fit of the stock mouthguards, the boil and bite mouthguards do not fully mould to the shape of the users teeth. More specifically the mouthguards do not mould closely to the indentation at the junction where the tooth and gum meet. It is preferable for a mouthguard to accurately fit to this junction as this helps the mouthguard to be retained by the teeth in the upper jaw. Hence, because boil and bite mouthguards do not fully mould to the junction boil and bite mouthguards are not retained well. Therefore, as with the stock mouthguards, the lower jaw, tongue or lips may need to be used to help keep the mouthguard in position.

Additionally, because of the method used to mould the mouthguard in the user's mouth the thickness of the base of the mouthguard, which covers the occlusal surface of the teeth, can become thinner than that required to give a reasonable level of protection. This reduces the amount of protection that the mouthguard is capable of providing.

The most effective mouthguards are custom mouthguards which are made individually for each user. Custom mouthguards are made by taking an impression of the user's teeth which can then be used to form a cast of the user's mouth's hard and soft tissues. The custom mouthguard is then fabricated, often in a laboratory, onto the cast of the user's mouth. The use of a cast ensures the mouthguard accurately fits over the users mouth. Furthermore, as the mouthguard is not formed by a user biting down on the material of the mouthguard the base of the mouthguard which is formed over the occlusal surface of the teeth does not become thinned. However, these mouthguards are expensive and it is therefore advantageous to make a "boil and bite" mouthguard which has many of the attributes of a custom made mouthguard.

One method that has been used to attempt to reduce the thinning at the base of a boil and bite mouthguard is the use of multiple plastics, the plastics having different ductility at the same temperature, within a mouthguard.

One example of a boil and bite mouthguard that incorporates three different types of plastics is illustrated in FIG. 1. In FIG. 1 the mouthguard 10 is made from a base material 12 which forms part of the bottom of the mouthguard 10 and part of the outer side wall of the mouthguard 10.

A second material 14 is situated on top of the base material 12. The second material 14 is more ductile than the base material 12 at the same temperature A third material 16 is more ductile than either the base material 12 or the second material 14 at the same temperature and is situated on top of the second material 14. This configuration of materials means that when a user bites into the mouthguard 10 to mould it they will cause the third material 16 to deform in response to a force, the second material 14 will deform slightly less than the third material 16 and the base material 12 should deform little reducing the likelihood of the surface covering the chewing surface of the teeth becoming thin.

However, this configuration of materials still does not result in optimal moulding. The mouthguard may still come loose from the teeth of the upper jaw and may therefore still need to be held in place by the lower jaw, tongue or lips. Therefore, it is desirable to have a user mouldable mouthguard which provides an improved fit to a user's teeth and maintains the thickness of the surface covering the chewing surface of the teeth.

In accordance with one aspect of the present invention there is provided a mouthguard comprising a base, an inner wall extending from the outer side of the base, an outer wall extending from the inner side of the base and a projection from the base, inner wall or outer wall.

Preferably the projection is substantially perpendicular to the inner and outer walls and extends from the inner wall to the outer wall. Advantageously there is a plurality of projections and there is a distance of approximately 5 mm between projections.

The base may comprise a first material, the first material being less ductile than the second material when the first and second material are at the same temperature.

Preferably the first material extends into the inner wall and outer wall such that the inner and outer walls at least partially comprise the first material. Advantageously, the first material extending into the inner wall and outer wall comprises projections which are complimentary to projections of the second material such that the first and second material interlock in the inner and outer walls.

Optionally, the projection may comprise a third material that is more ductile than the material from which the inner and outer walls and base are made when the materials are at the same temperature.

A mouthguard comprising a base including a first material, inner and outer walls including a second material, the first material being less ductile than the second material when the first and second material are at the same temperature.

FIG. 2 illustrates an example of a mouthguard in accordance with the first embodiment of the present invention.

Figure 1:
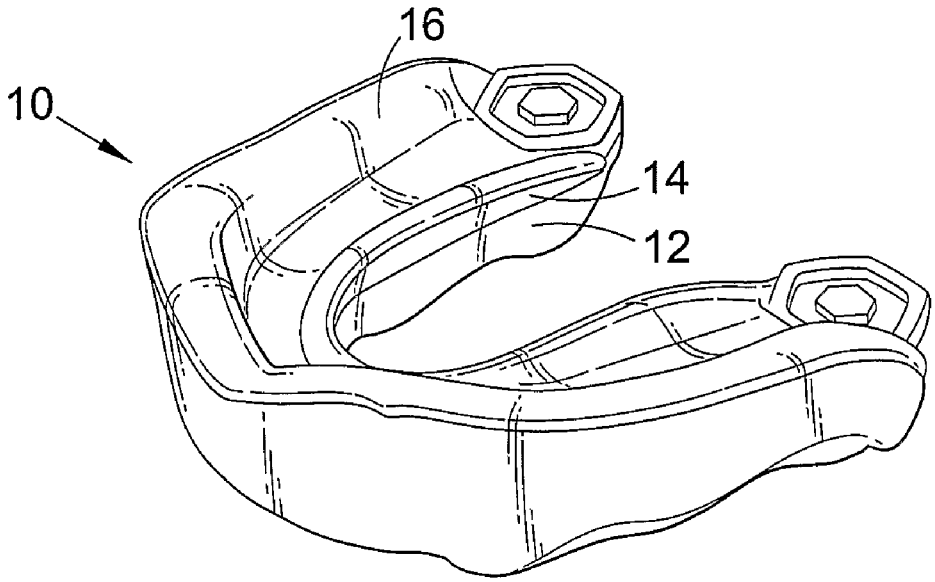
FIG. 1 illustrates a mouthguard in accordance with the prior art.

The mouthguard 20 is made from at least one thermoplastic material that is relatively rigid and cannot be permanently deformed at room or body temperature. On heating, for example by placing the mouthguard in water for a short period of time which may be anywhere between a few seconds to a few minutes, the material becomes ductile and can be deformed with relatively little force, such deformation remaining permanent when the material returns to room or body temperature.

The mouthguard 20 is provided with a base 22 from which an inner wall 24 and an outer wall 26 extend. The base 22 is designed to be adjacent to the occlusal surface of the teeth when the mouthguard 20 is in use. The inner wall 24 is adjacent to the palatal surface of the teeth.

The outer wall 26 is adjacent to the buccal surface of the teeth and can be seen when the mouthguard 20 is in use.

The base 22 of the mouthguard 20 is provided with one or more projections 28. If there is a plurality of projections they are preferably situated equidistantly throughout the area defined by the base, inner and outer walls.

Figure 2:
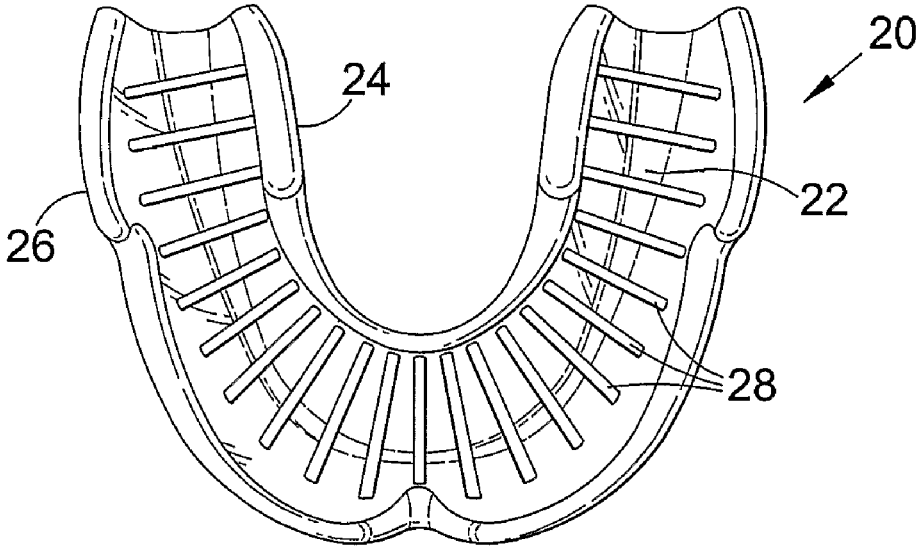
FIG. 2 illustrates a bird eye view of a mouthguard in accordance with the present invention.
Figure 3:
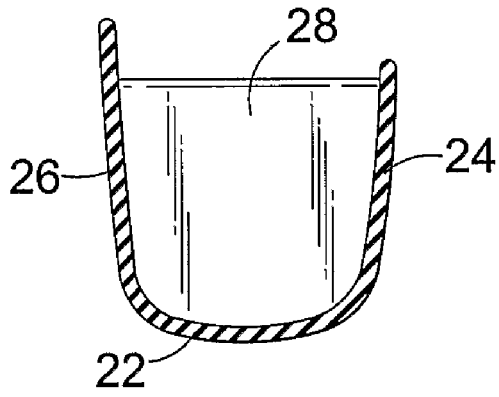
FIG. 3 illustrates a view of a projection from one end of the mouthguard.

In one embodiment the projections 28 extend from the base 22 in the same direction as the inner wall 24 and outer wall 26 of the mouthguard 20. Preferably, the projections are sheets of thermoplastic material integral with and perpendicular to the base, inner and outer wall as illustrated in FIGS. 2 and 3. This is advantageous because when the user bites into the mouthguard the configuration of the projections means that the projections mould closely to the teeth and the inner and outer walls are kept more in alignment and do not move away from each other.

Alternatively, the projections may be formed from one or more sheets that extend from one or both of the inner and outer walls (not illustrated). These projections may or may not be integral with the base. The projections extend partially across the width of the mouthguard leaving the centre unobstructed by the projections. If there is a plurality of projections on both the inner and outer walls then the projections may be placed opposite to each other so that the sheets are in the same plane. Optionally, the projections may alternate instead so that, for example, a projection from the outer wall is situated in between two projections from the inner wall.

In a further embodiment the projections may comprise bars that extend from the inner wall to the outer wall. The bars may extend from the top of the inner wall or be placed at any other suitable position along the height of the inner or outer wall. Optionally, two or more bars may be situated such that they form a row of bars perpendicular to the base. The arrangement would be such that the bars would form a parallel line when viewed from above.

Preferably, the cross section of the projections is 1 mm and the distance between the projections is approximately 5 mm; however any other appropriate cross section and spacing may be used. A variety of cross sections and spacings may be incorporated in the mouthguard.

To shape the mouthguard so that it fits the user's mouth, the mouthguard is then heated, preferably in boiling water, until at least the projections become ductile. The mouthguard is then placed into the user's mouth and the user bites down on the mouthguard. The force of the teeth on the projections causes the projections to deform and mould around the shape of the teeth. In this manner an improved fit of the mouthguard to the teeth can be achieved.

Additionally, because the width of the projections is much less than that of the base the projections more quickly reach the deformation temperature of the material from which they are made. Thus, the projections may be deformed to produce a mouthguard that is shaped to the user's teeth with minimal deformation to the base reducing the thinning of the base and thereby increasing the amount of protection the mouthguard affords the user.

In order to decrease the amount of deformation that can occur to the base further the base may include a material with a higher deformation temperature than at least that of the projections. A mouthguard with a base having a higher deformation temperature is shown in FIG. 4.

Figure 4:
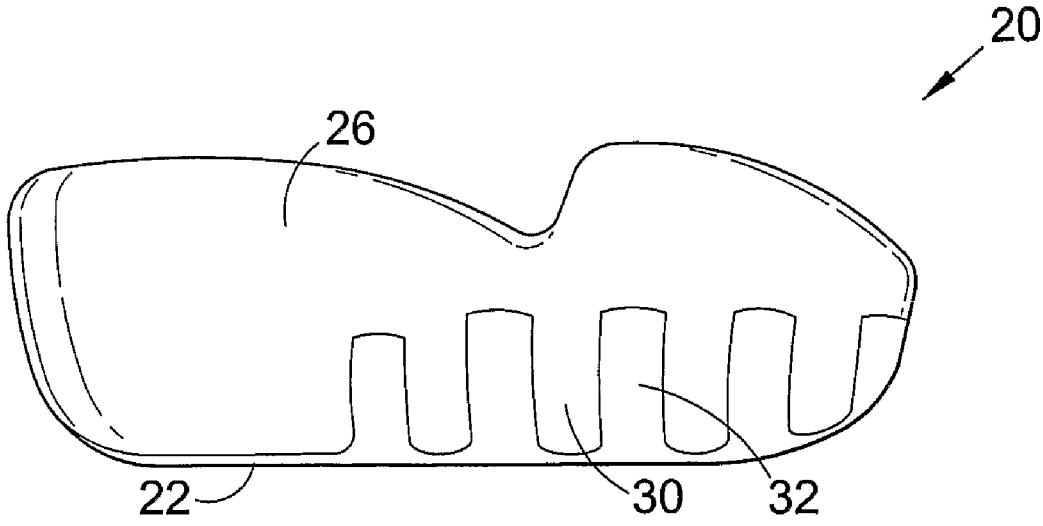
FIG. 4 illustrates a side view of a mouthguard having a base with a higher deformation temperature than that of the walls.

In FIG. 4 the mouthguard 20 is provided with a base 22 that has a higher deformation temperature than that of the walls, the outer wall 26 being illustrated in FIG. 4. As the base 22 deforms at a higher temperature than the walls and projections the base undergoes minimal deformation at the temperature at which the projections can be moulded by the mouth. Thus, the likelihood of the base deforming is reduced and hence there is minimal thinning of the base.

In order to improve the attachment between the base material and the wall material the walls may optionally partially comprise the base material. Even more advantageously the base material and wall material may be formed into complementary protrusions such as the protrusions 30 and 32 illustrated in FIG. 4.

Protrusions 30 and 32 interlock in such a manner that the adherence between the base and the walls is maintained on heating. The protrusions may also be present between the base and the inner wall (not shown). The protrusions may extend around the entirety of the length of the wall. Alternatively, they may only extend around a portion of the wall.

It will be understood that the base of the mouthguard may only partially include the material with a higher deformation temperature such that the base comprises two materials, one with a higher deformation temperature than the other. The two materials may also be provided with complimentary protrusions as described above.

The material of the projections that extend from the base and between the inner and outer walls may have the same deformation temperature as that of the walls. Alternatively, it may have a lower deformation temperature than that of the walls. This means that the projections will deform at a much lower heat than the walls improving moulding to the teeth without significant deformation of the shape of the walls of the mouthguard.

The invention claimed is:

1. A mouthguard comprising (a) a base;

(b) an inner wall extending from the inner side of the base;

(c) an outer wall extending from the outer side of the base; and (d) a projection from the inner wall and extending to the outer wall;

wherein the base comprises a first material and the projection comprises a second material, the first material having a higher deformation temperature than the second material.

2. A mouthguard as claimed in claim 1 wherein the projection comprises a bar extending from the inner wall to the outer wall.

3. A mouthguard as claimed in claim 2 wherein the bar extends from the top of the inner wall.

4. A mouthguard as claimed in claim 2 comprising a plurality of bars positioned in a line perpendicular to the base.

5. A mouthguard as claimed in claim 1 wherein the inner and outer walls comprise a third material, the first material extends into the third material of the inner wall and outer wall such that the inner and outer walls at least partially comprise the first material.

6. A mouthguard as claimed in claim 5 wherein the first material extends into the inner wall and outer wall such that the first and third materials form complementary projections which interlock in the inner and outer walls.

7. A mouthguard as claimed in claim 5 wherein the second material is more ductile than the third material when the second and third materials are at the same temperature.

8. A mouthguard as claimed in claim 1 wherein the projection extends from the base between the inner wall and the outer wall.

9. A mouthguard as claimed in claim 8 wherein the projection is substantially perpendicular to the inner and outer walls.

10. A mouthguard as claimed in claim 1 wherein the projection becomes ductile when heated above the deformation temperature.

11. A mouthguard as claimed in claim 10 wherein, in use, the projections are deformed by teeth when heated above the deformation temperature and are maintained in the deformed state once the mouthguard is cooled below the deformation temperature.

12. A mouthguard as claimed in claim 1 wherein the projection is a thin, flat projection.

13. A mouthguard as claimed in claim 1 wherein there are a plurality of projections positioned equidistantly throughout the area defined by the base and inner and outer walls of the mouthguard.

14. A mouthguard as claimed in claim 1 wherein the mouthguard includes a plurality of projections and there is a distance of approximately 5 mm between projections.

15. A mouthguard as claimed in claim 1 wherein the second material is more ductile than the first material when the first and second materials are at the same temperature.

* * * * *